US009574565B2

(12) United States Patent
Teramoto et al.

(10) Patent No.: US 9,574,565 B2
(45) Date of Patent: Feb. 21, 2017

(54) CENTRIFUGAL FAN HAVING MAIN BLADE WITH AXIALLY UPPER END PROJECTING UPWARD

(71) Applicant: NIDEC CORPORATION, Kyoto (JP)

(72) Inventors: Takuya Teramoto, Kyoto (JP); Hiroyoshi Teshima, Kyoto (JP)

(73) Assignee: NIDEC CORPORATION (JP)

( * ) Notice: Subject to any disclaimer, the term of this patent is extended or adjusted under 35 U.S.C. 154(b) by 703 days.

(21) Appl. No.: 13/781,811

(22) Filed: Mar. 1, 2013

(65) Prior Publication Data

US 2013/0236303 A1 Sep. 12, 2013

(30) Foreign Application Priority Data

Mar. 12, 2012 (JP) ..... 2012-054906

(51) Int. Cl.

*F04D 17/08* (2006.01)
*F04D 29/30* (2006.01)
*F04D 29/42* (2006.01)

(52) U.S. Cl.

CPC ..... *F04D 17/08* (2013.01); *F04D 29/30* (2013.01); *F04D 29/4213* (2013.01); *F04D 29/4226* (2013.01)

(58) Field of Classification Search

CPC ..... F04D 17/08; F04D 17/16; F04D 25/06; F04D 25/08; F04D 29/26; F04D 29/30; F04D 29/281; F04D 29/403; F04D 29/4206; F04D 29/4226; F04D 29/4213

See application file for complete search history.

(56) References Cited

U.S. PATENT DOCUMENTS 4,432,694 A * 2/1984 Kuroda ..... F04D 29/162 415/172.1
4,900,228 A * 2/1990 Yapp ..... F04D 29/681 416/183
6,210,109 B1 4/2001 Will et al.
6,224,335 B1 * 5/2001 Parisi ..... F04D 29/162 415/206
2003/0012649 A1 1/2003 Sakai (Continued)

FOREIGN PATENT DOCUMENTS

CN 1341813 A 3/2002
JP 02052019 A 2/1990

(Continued)

*Primary Examiner* — William H Rodriguez
*Assistant Examiner* — Charles Nichols
(74) *Attorney, Agent, or Firm* — Cantor Colburn LLP

(57) ABSTRACT

A centrifugal fan may include an impeller arranged to rotate about a rotation axis, an impeller case arranged to accommodate the impeller, a motor arranged to rotate the impeller, and a motor case arranged to accommodate the motor. The impeller may include a boss portion joined to a shaft arranged to rotate about the rotation axis, a hub arranged to extend radially outward from the boss portion, and a plurality of blades. Each blade may be arranged to extend radially outward. An inner wall of the impeller case may include an inside surface extending radially outward along an upper end portion of each blade. A side end portion of an air inlet defined in a central portion of the impeller case may include a curved surface projecting radially inward.

12 Claims, 5 Drawing Sheets

(56) References Cited

U.S. PATENT DOCUMENTS

| | | | | |
|---|---|---|---|---|
| 2004/0131465 | A1* | 7/2004 | Ochiai | F01D 9/026 415/206 |
| 2006/0081226 | A1 | 4/2006 | Bolz | |
| 2009/0291004 | A1* | 11/2009 | Grasmuck | A61M 16/0066 417/423.14 |

FOREIGN PATENT DOCUMENTS

| | | | |
|---|---|---|---|
| JP | 4-370399 | A | 12/1992 |
| JP | 9-14192 | A | 1/1997 |
| JP | 11042182 | A | 2/1999 |
| JP | 2004204756 | A | 7/2004 |
| JP | 2005065359 | A | 3/2005 |
| JP | 2006207595 | A | 8/2006 |
| JP | 2007146746 | A | 6/2007 |
| JP | 2010053815 | A | 3/2010 |
| JP | 2010203242 | A | 9/2010 |

* cited by examiner

CENTRIFUGAL FAN HAVING MAIN BLADE WITH AXIALLY UPPER END PROJECTING UPWARD

CROSS REFERENCE TO RELATED APPLICATIONS

The present application claims priority under 35 U.S.C. §119 to Japanese Application No. 2012-054906, filed Mar. 12, 2012, the entire content of which is incorporated herein by reference.

FIELD OF THE INVENTION

The present invention relates to a centrifugal fan.

BACKGROUND

In the case of a centrifugal fan, a gas sucked in through an air inlet is pushed radially outward by a centrifugal force produced by rotation of an impeller, and then whirls in a circumferential direction through an annular air channel portion provided around the impeller, and the gas is thereafter discharged outwardly through an air outlet.

In a medical appliance such as a respirator or a sputum aspirator, a centrifugal fan generally needs to be used to cause a flow of a gas in order to provide an aid in respiration or to facilitate suction. The centrifugal fan used in such a medical appliance is required to have a high static pressure and a large air volume, and, in addition, to produce little noise in view of an environment in which the medical appliance is used.

JP-A 9-14192, for example, describes a centrifugal fan which includes an air current guide at an air inlet, and which thereby achieves reduced noise.

In the centrifugal fan described in JP-A 9-14192, the ratio of the area of an imaginary circle joining center-side ends of blades of a centrifugal impeller to the area of an entry of the air inlet is optimized while the air current guide is provided to smoothly guide an air current at the air inlet. In addition, the air current guide is arranged to be in the shape of a circular arc in a cross-section, and a seal member which is in sliding contact with an entry portion defined at a center of a side plate of the centrifugal impeller is attached to an inside of the circular arc so that the air inlet can be kept airtight. That is, provision of the air current guide and the seal member is necessary to achieve a high static pressure and low noise, and this leads to a complicated structure.

SUMMARY

A centrifugal fan according to at least an embodiment of the present invention includes an impeller arranged to rotate about a rotation axis, an impeller case arranged to accommodate the impeller, a motor arranged to rotate the impeller, and a motor case joined to the impeller case and arranged to accommodate the motor. The impeller includes a boss portion joined to a shaft arranged to rotate about the rotation axis, a hub arranged to extend radially outward from an outer circumferential surface of the boss portion, and a plurality of blades arranged on an upper surface of the hub. Each blade is arranged to extend radially outward away from the rotation axis. An inner wall of the impeller case is arranged to cover the blades, and includes an inside surface extending radially outward along an upper end portion of each blade. The impeller case includes an air inlet defined in a central portion thereof, with a side end portion of the air inlet including a curved surface projecting radially inward.

At least an embodiment of present invention is able to provide a centrifugal fan which is excellent in a static pressure characteristic and an air volume characteristic and which produces relatively little noise.

The above and other elements, features, steps, characteristics and advantages of the present invention will become more apparent from the following detailed description of the preferred embodiments with reference to the attached drawings.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Hereinafter, embodiments of the present invention will be described in detail with reference to the accompanying drawings. In the following description of some embodiment examples, it is assumed that a direction parallel to a rotation axis is referred to by the term "axial direction", "axial", or "axially", that radial directions centered on the rotation axis are referred to by the term "radial direction", "radial", or "radially", and that a circumferential direction about the rotation axis is referred to by the term "circumferential direction", "circumferential", or "circumferentially". It is also assumed that an axial direction is a vertical direction, and that a side on which an impeller is arranged with respect to a motor is defined as an upper side. The shape of each member or portion and relative positions of different members or portions will be described based on the above assumptions.

Note that the present invention is not limited to the embodiments described below. It is to be understood by those skilled in the art that variations and modifications can be made appropriately as long as desired effects of the present invention are not impaired. Also note that the embodiments described below may be modified and/or combined with other embodiments of the present invention and that the embodiments below should not be considered to limit the scope of the invention.

Figure 1:
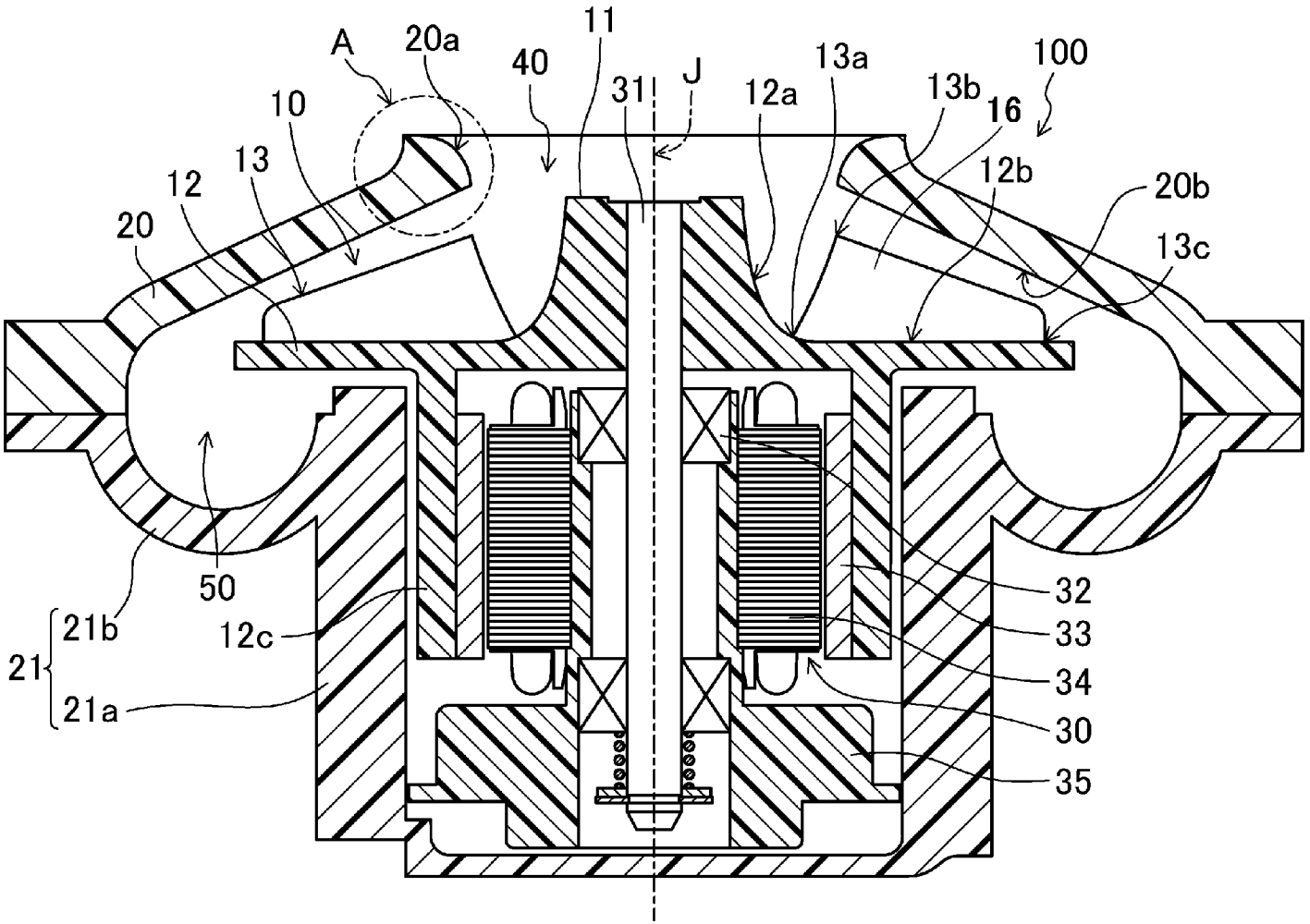
FIG. 1 is a cross-sectional view illustrating the structure of a centrifugal fan according to at least an embodiment.
Figure 2:
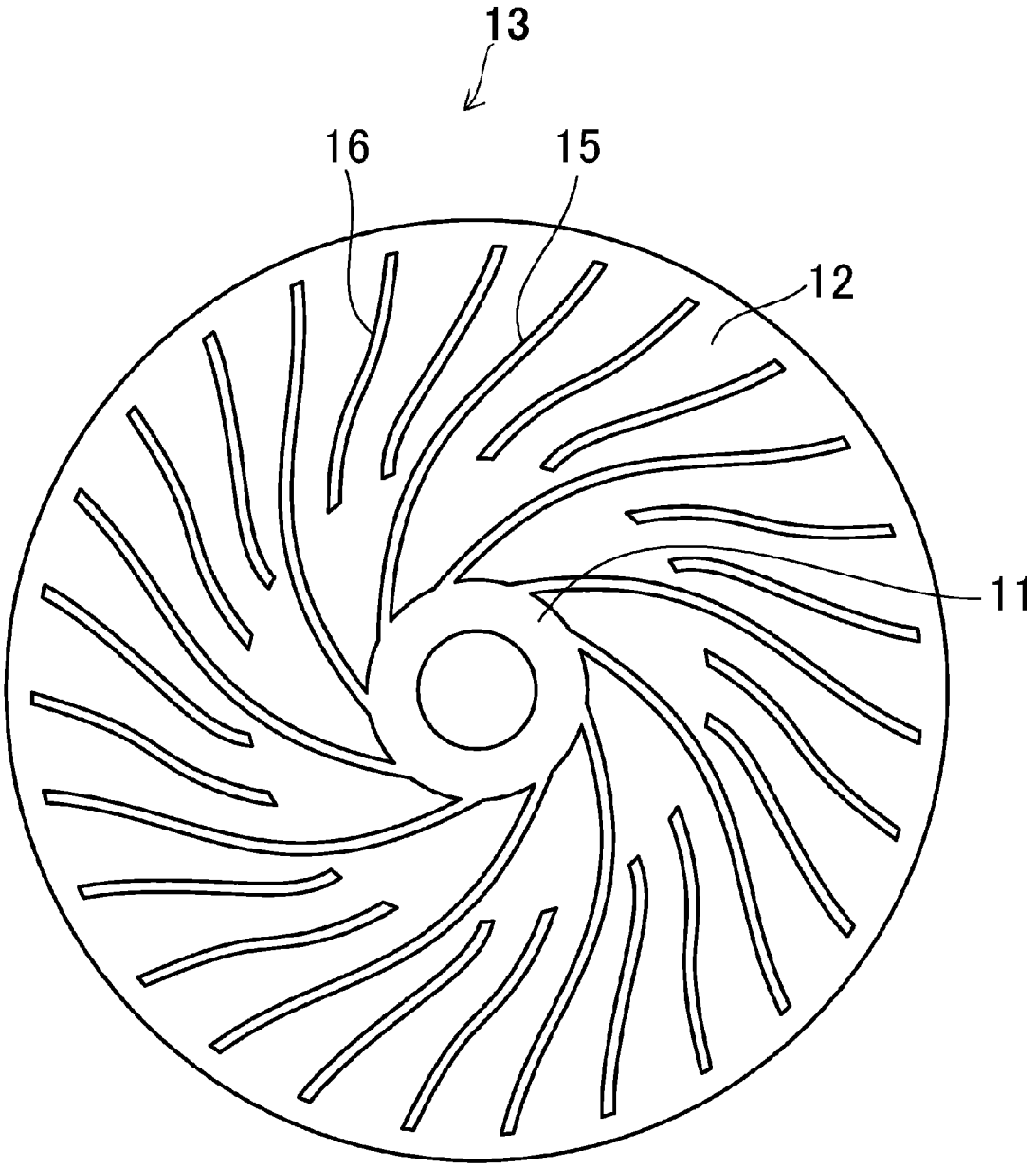
FIG. 2 is a plan view illustrating the structure of an impeller according to at least an embodiment.
Figure 3:
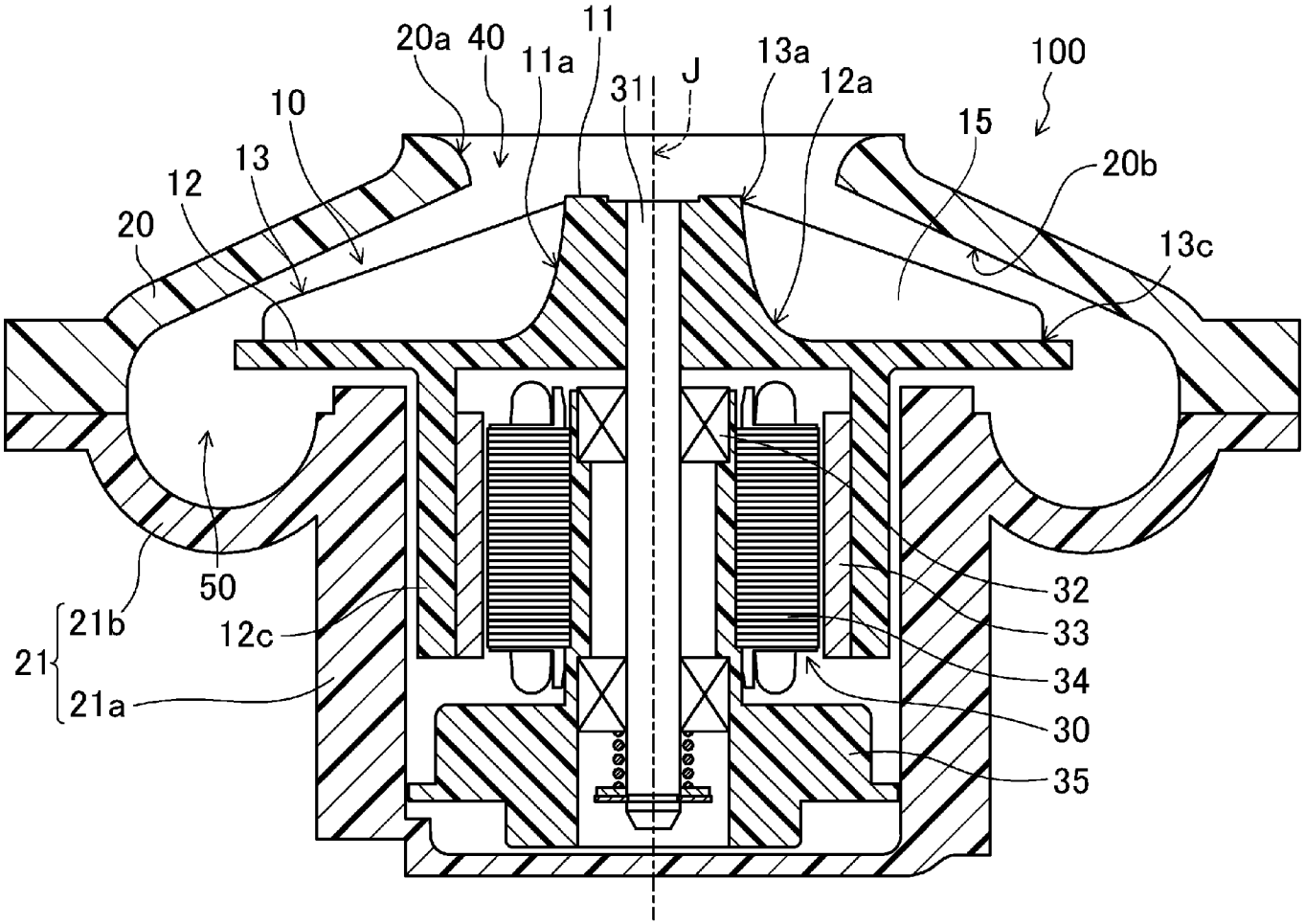
FIG. 3 is a cross-sectional view of a centrifugal fan according to at least an embodiment, illustrating another structure of the impeller.

FIG. 1 is a schematic cross-sectional view illustrating the structure of a centrifugal fan 100 according to at least an embodiment of the present invention. FIG. 2 is a plan view illustrating the structure of an impeller 10 according to at least an embodiment of the present invention. FIG. 3 is a cross-sectional view of a centrifugal fan according to at least an embodiment of the present invention, illustrating another structure of the impeller 10.

Referring to FIG. 1, the centrifugal fan 100 according to the present embodiment includes the impeller 10, which is arranged to rotate about a rotation axis J, an annular air channel portion 50 arranged around the impeller 10, an impeller case 20 arranged to accommodate the impeller 10 and including an air inlet 40 defined above the impeller 10, a motor 30 arranged to rotate the impeller 10, and a motor case 21 joined to the impeller case 20 and arranged to accommodate the motor 30.

The impeller 10 includes a boss portion 11 joined to a shaft 31 arranged to rotate about the rotation axis J, a hub 12 arranged to extend radially outward from an outer circumferential surface of the boss portion 11, and a plurality of blades 13 arranged on an upper surface of the hub 12.

The boss portion 11 is substantially tubular, and is joined to an outer circumferential surface of the shaft 31, which extends in the vertical direction along the rotation axis J, on an upper side of the motor 30. The shaft 31 is thereby supported with increased strength, and the likelihood that rotation of the impeller 10 will cause the shaft 31 to be shaken is reduced.

Note that the boss portion 11 may include a cover portion arranged to project upward while covering an upper end portion of the shaft 31. The cover portion includes a curved surface. This enables a gas sucked in through a side end portion 20*a* of the air inlet 40 to efficiently flow toward the air channel portion 50 along the curved surface, resulting in an improvement in static pressure and an air volume characteristic.

The upper surface of the hub 12 includes a slanting surface 12*a* and a flat surface 12*b*. The slanting surface 12*a* is arranged to extend from the outer circumferential surface of the boss portion 11 obliquely downward and radially outward. The flat surface 12*b* is arranged to extend from a radially outer end of the slanting surface 12*a* substantially perpendicularly to the rotation axis J. This enables a gas sucked in through the air inlet 40 to efficiently flow toward the air channel portion 50 along the slanting surface 12*a*, resulting in an improvement in the static pressure and the air volume characteristic. Note that the slanting surface 12*a* may be either an inclined surface having a constant slope or a curved surface having a varying slope.

Note that the slanting surface 12*a* may include a curved surface concaved radially inwardly and downwardly. A space is thereby secured radially outside the boss portion 11, and this enables the gas sucked in through the air inlet 40 to efficiently flow toward the air channel portion 50 along the curved surface. In other words, a channel for the gas sucked in through the air inlet 40 is thereby made wider, resulting in an improvement in the static pressure and the air volume characteristic.

A periphery of the flat surface 12*b* of the hub 12 is may be arranged to project radially outwardly relative to a periphery of each of the blades 13. The gas sucked in through the air inlet 40 is discharged radially outward into the air channel portion 50 through rotation of the blades 13. At this time, a gas which has once flown into the air channel portion 50 through the air inlet 40 does not easily flow backward toward the air inlet 40 when the periphery of the flat surface 12*b* projects radially outwardly relative to the periphery of each blade 13. This leads to an increase in the density of the gas in the air channel portion 50, resulting in an increase in the static pressure.

Moreover, the hub 12 may include a slanting surface radially outside the periphery of the flat surface 12*b*, the slanting surface extending obliquely downward and radially outward. This enables the gas sucked in through the air inlet 40 to efficiently flow into the air channel portion 50. Note that this slanting surface may be either an inclined surface having a constant slope or a curved surface having a varying slope.

Referring to FIG. 1, each of the blades 13 is arranged to extend radially outward away from the rotation axis J in a cross-sectional view. In addition, each blade 13 has a radially inner end 13*a* positioned most radially inward, an axially upper end 13*b* projecting upward, and a radially outer end 13*c* positioned most radially outward. That is, each blade 13 extends from the radially inner end 13*a* radially outward and upward toward the axially upper end 13*b*, and extends from the axially upper end 13*b* radially outward and downward toward the radially outer end 13*c*. Note, however, that each blade 13 may be arranged to extend from the radially inner end 13*a* radially outward and downward as illustrated in FIG. 3.

In addition, referring to FIG. 2, the blades 13 are arranged to extend radially outward in a radial manner while slanting in the same direction as a rotation direction of the centrifugal fan 100 in a plan view. Furthermore, the blades 13 include main blades 15 and auxiliary blades 16. Two of the auxiliary blades 16 are arranged between every adjacent ones of the main blades 15 in a circumferential direction. Note, however, that only one of the auxiliary blades 16 may be arranged between every adjacent ones of the main blades 15 in the circumferential direction. In other words, the main blades 15 and the auxiliary blades 16 may be arranged alternately in the circumferential direction.

An inner wall of the impeller case 20, which is arranged to cover the blades 13, includes an inside surface 20*b* extending radially outward along an upper end portion of each blade 13. The upper end portion of each blade 13 and the inside surface 20*b* of the impeller case 20 are opposed to each other while extending substantially parallel to each other. Each of the main blades 15 and the auxiliary blades 16 may be opposed to the inside surface 20*b* of the impeller case 20 while extending substantially parallel to the inside surface 20*b* on a radially outer side of the axially upper end 13*b* thereof.

The impeller case 20 includes the air inlet 40 in a central portion thereof, and a curved surface projecting radially inward at the side end portion 20*a* of the air inlet 40. Here, the rotation of the impeller 10 causes the gas sucked in through the air inlet 40 to pass through the air channel portion 50 and whirl in the circumferential direction, and be thereafter discharged through an air outlet (not shown).

The motor 30 includes a bearing 32 arranged to support a rotor magnet 33 such that the rotor magnet 33 is rotatable about the rotation axis J, a bearing support portion 35 arranged to support the bearing 32, and a stator 34 supported by the bearing support portion 35. The hub 12, which is fixed to the shaft 31 arranged to rotate about the rotation axis J, includes a substantially cylindrical rotor support portion 12*c* extending downward. The rotor magnet 33 is fixed to an inner circumferential surface of the rotor support portion 12*c*. Note that, although the motor 30 illustrated in FIG. 1 is an outer-rotor motor, motors according to other embodiments of the present invention may be inner-rotor motors.

As a result of supply of a drive current to the stator 34, a torque is generated between the rotor magnet 33 and the stator 34. The impeller 10, which is fixed to the shaft 31, is thereby caused to rotate about the rotation axis J.

The motor case 21 includes a motor accommodating portion 21*a* arranged radially outside the motor 30 to surround the motor 30, and a recessed portion 21*b* arranged radially outward of the motor accommodating portion 21*a* and recessed downward. The motor accommodating portion 21*a* is arranged radially outside the rotor support portion 12*c*. The recessed portion 21*b* is joined to the impeller case 20 at a radially outer end portion thereof.

The recessed portion 21*b* includes a curved surface. The curved surface included in the recessed portion 21*b* enables a gas which has flown into the recessed portion 21*b* along the inside surface of the impeller case 20 through the air inlet 40 to efficiently flow from radially outside to radially inside in the recessed portion 21*b*. A gas which has flown radially inward in the recessed portion 21*b* is pushed toward the air outlet (not shown) as a result of the rotation of the impeller 10 adding a circumferential whirl velocity component to the gas. In short, the curved surface included in the recessed portion 21*b* enables the gas sucked in through the air inlet 40 to be efficiently discharged through the air outlet (not shown).

In the present embodiment, the radially inner end 13*a* of each blade 13 is arranged as radially inward as possible. Specifically, the radially inner end 13*a* is arranged radially inward of the side end portion 20*a* of the air inlet 40. This enables the gas sucked in through the air inlet 40 to efficiently flow into the air channel portion 50 through the rotation of the blades 13, leading to an increase in the static pressure. Meanwhile, when the radially inner end 13*a* of each blade 13 is positioned radially inward, the channel for the gas sucked in through the air inlet 40 is narrowed, resulting in increased noise. In order to reduce noise, it is necessary to decrease the size of an opening of the air inlet 40. However, a decrease in the size of the opening of the air inlet 40 results in a decrease in air volume. Accordingly, in the present embodiment, the side end portion 20*a* of the air inlet 40 is provided with the curved surface projecting radially inward in order to reduce the decrease in the air volume. This enables the gas to be efficiently sucked in through the air inlet 40, resulting in a reduction in the decrease in the air volume and also a reduction in noise.

In short, the present embodiment is directed to the centrifugal fan in which the radially inner end 13*a* of each blade 13 is arranged as radially inward as possible, and achieves an increase in the static pressure and the air volume and a reduction in noise by providing the curved surface projecting radially inward at the side end portion 20*a* of the air inlet 40 while decreasing the size of the opening of the air inlet 40.

Moreover, in the present embodiment, each blade 13 extends radially outward away from the rotation axis J, and at the same time the inner wall of the impeller case 20 includes the inside surface 20*b* extending radially outward along the upper end portion of each blade 13. This enables the gas sucked in through the air inlet 40 to be discharged downward and radially outward through the rotation of the blades 13, and accordingly to efficiently flow into the air channel portion 50.

Note that the boss portion 11, the hub 12, and the blades 13 of the impeller 10 according to the present embodiment may be defined integrally with one another. For example, the boss portion 11, the hub 12, and the blades 13 may be molded by an injection molding process as a single continuous member.

Here, the amount of the gas sucked in through the air inlet 40 (i.e., the air volume) depends on the size of the opening of the air inlet 40. Therefore, the air volume characteristic can be improved by securing a wider channel for the gas sucked in. Note that the size of the opening of the air inlet 40 does not simply refer to the radial dimension of the side end portion 20*a* of the air inlet 40 of the impeller case 20, but refers to the area of the opening defined by the side end portion 20*a* of the air inlet 40.

The amount of the gas sucked in through the air inlet 40 (i.e., the air volume) depends not only on the size of the opening of the air inlet 40 but also on the shape of the side end portion 20*a* of the air inlet 40 and relative positions of the air inlet 40 and components of the centrifugal fan 100 near the air inlet 40.

Figure 4:
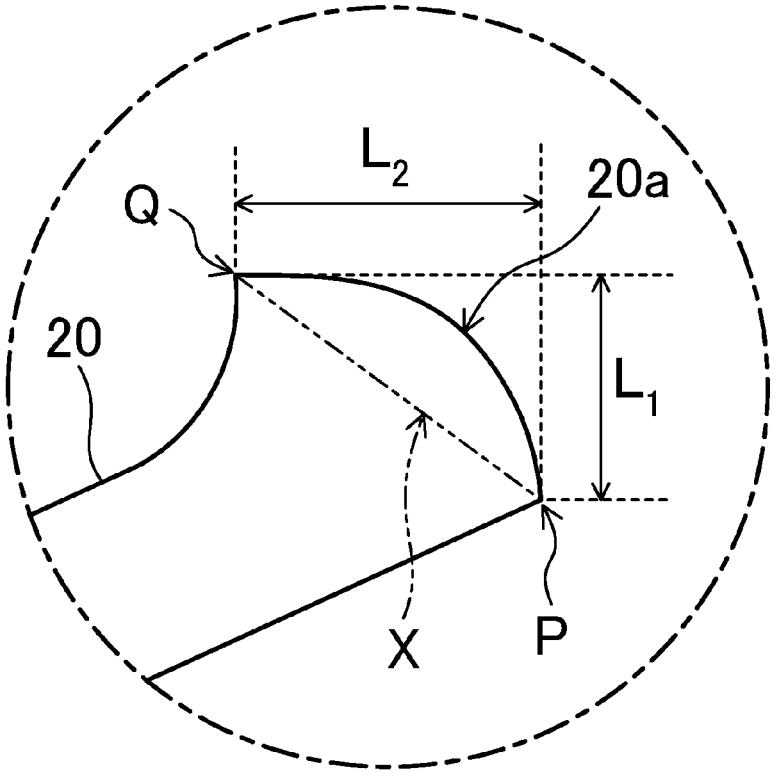
FIG. 4 is a diagram illustrating a side end portion of an air inlet and its vicinity of the centrifugal fan illustrated in FIG. 1 in an enlarged form.

Hereinafter, the shape of the side end portion 20*a* of the air inlet 40 and the relative positions of the air inlet 40 and the components of the centrifugal fan 100 near the air inlet 40 will now be described below with reference to FIG. 4. Note that the shape of the curved surface provided at the side end portion 20*a* of the air inlet 40 is not limited in any particular manner in the present embodiment. FIG. 4 is a diagram illustrating an area A in FIG. 1 in an enlarged form, the area A including the side end portion 20*a* of the air inlet 40 of the impeller case 20 and its vicinity.

Referring to FIG. 4, the curved surface of the side end portion 20*a* of the air inlet includes a radially innermost end P and an axially uppermost end Q. The curved surface of the side end portion 20*a* of the air inlet 40 is arranged to project radially inwardly relative to an imaginary line X which joins the radially innermost end P and the axially uppermost end Q. That is, the curved surface of the side end portion 20*a* of the air inlet 40 is arranged to project upwardly relative to the radially innermost end P of the curved surface of the side end portion 20*a* of the air inlet 40. This enables the gas to be sucked in more efficiently along the curved surface of the side end portion 20*a*. This leads to an additional increase in the static pressure of the centrifugal fan 100.

In addition, the radially innermost end P includes a minute round portion. This enables the gas to be sucked in more efficiently along the round portion. This leads to an additional increase in the static pressure of the centrifugal fan 100.

The gas sucked in through the air inlet 40 experiences flow separation at the radially innermost end P with a high probability. Once the gas experiences the flow separation, turbulence occurs to interfere with efficient suction of the gas. The minute round portion included in the radially innermost end P contributes to preventing the gas from experiencing the flow separation at the radially innermost end P, and promoting efficient suction of the gas.

Note that it is easy to define the above-described curved surface of the side end portion 20*a* since the curved surface is arranged to project radially inward and upward as illustrated in FIG. 1.

In addition, referring to FIG. 4, the curved surface of the side end portion 20*a* of the air inlet may be arranged to have an axial dimension $L_1$ smaller than the radial dimension $L_2$ thereof. This arrangement contributes to increasing the amount of the gas sucked in through the air inlet 40, and thereby further improving the air volume characteristic.

Note that the axial dimension $L_1$ refers to the shortest distance between the radially innermost end P and a point of intersection of a line perpendicular to the rotation axis J and passing through the axially uppermost end Q with a line parallel to the rotation axis J and passing through the radially innermost end P. Meanwhile, the radial dimension $L_2$ refers to the shortest distance between the axially uppermost end Q and the aforementioned point of intersection.

Moreover, the radially innermost end P including the minute round portion is may be arranged on a lower side of a tangent to the side end portion 20*a* passing through a radially inner end of a joint between the hub 12 and each main blade 15. That is, the radially inner end of the joint between the hub 12 and each main blade 15 may be arranged radially inward of the radially innermost end P. This arrangement contributes to preventing the gas from experiencing the flow separation at the radially innermost end P while enabling more efficient suction of the gas.

Furthermore, an upper end portion of the boss portion 11 is arranged at a level lower than that of the radially innermost end P of the side end portion 20*a* of the air inlet 40. Furthermore, the upper end portion of the boss portion 11 is arranged radially inward of the radially innermost end P of the side end portion 20*a* of the air inlet 40. A wider channel for the gas sucked in through the air inlet 40 is thereby secured, leading to an improvement in the air volume characteristic.

Furthermore, each main blade 15 is arranged to extend radially outward from a point radially inward of the radially innermost end P of the side end portion 20*a* of the air inlet 40. The axially upper end 13*b* of each main blade 15 is arranged radially outward of the radially innermost end P of the side end portion 20*a* of the air inlet 40. Each auxiliary blade 16 is arranged to extend radially outward from a point radially outward of the radially innermost end P of the side end portion 20*a* of the air inlet 40.

The distance between each main blade 15 and the inside surface 20*b* of the impeller case 20 is arranged to be shortest at the axially upper end 13*b* of the main blade 15. This arrangement enables the gas sucked in through the air inlet 40 to efficiently flow into the air channel portion 50, resulting in an increase in the static pressure. Meanwhile, the distance between each auxiliary blade 16 and the inside surface 20*b* of the impeller case 20 is arranged to be shortest at the radially outer end 13*c* of the auxiliary blade 16. This arrangement makes it easier to add a circumferential whirl velocity component to a gas which has flown into the air channel portion 50, leading to an increase in the air volume.

Figure 5:
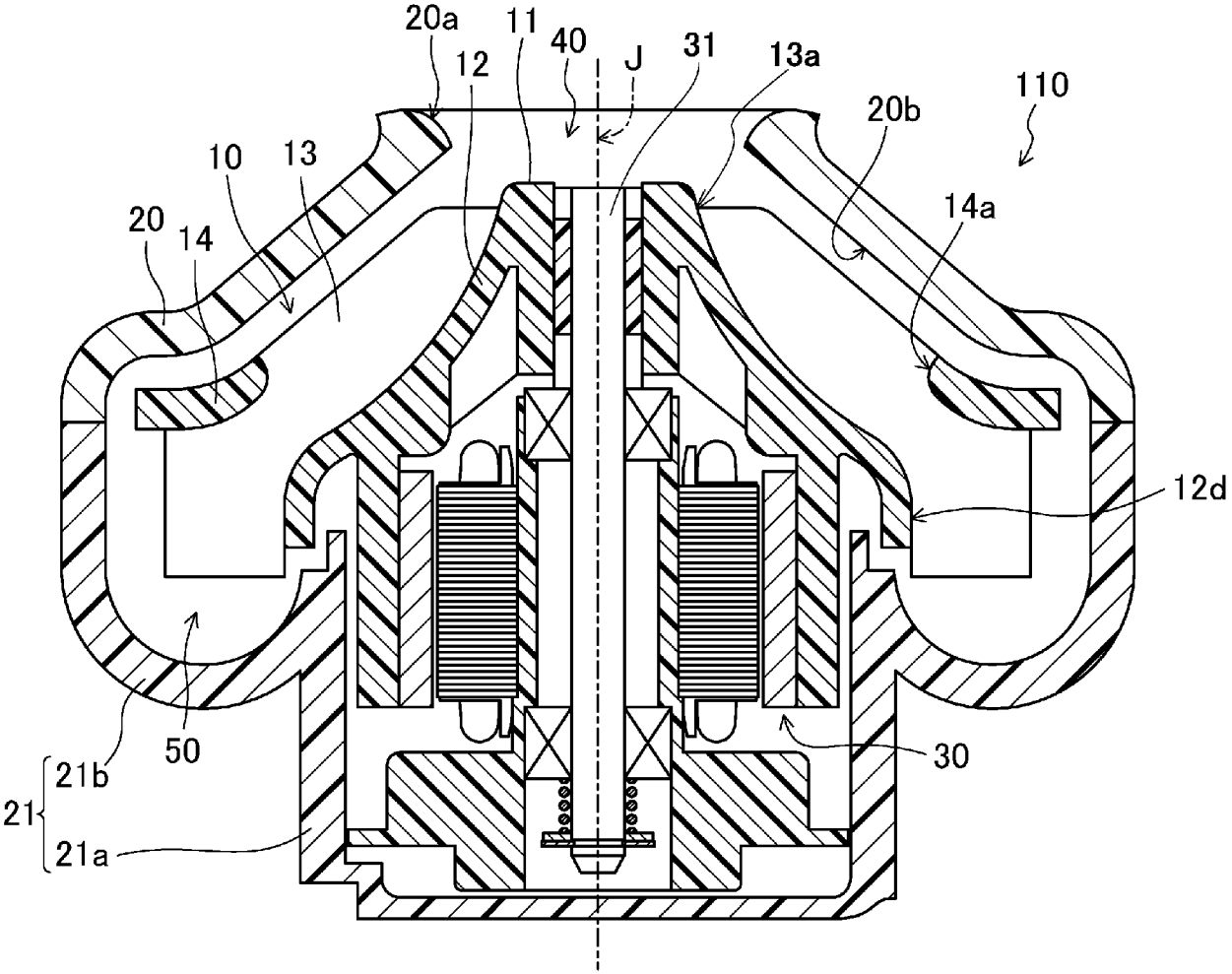
FIG. 5 is a cross-sectional view illustrating the structure of a centrifugal fan according to at least an embodiment.

FIG. 5 is a schematic cross-sectional view illustrating the structure of a centrifugal fan 110 according to at least an embodiment. The centrifugal fan 110 according to the present embodiment is a so-called mixed flow fan.

The structure of an impeller 10 according to the present embodiment is different from the structure of the impeller 10 illustrated in FIG. 1. The structure of a motor 30 according to the present embodiment is identical to the structure of the motor 30 illustrated in FIG. 1, and a description thereof is therefore omitted.

The impeller 10 according to the present embodiment includes a boss portion 11 joined to a shaft 31 arranged to rotate about a rotation axis J, a hub 12 arranged to extend obliquely downward and radially outward from a portion of an outer circumferential surface of the boss portion 11, and a plurality of blades 13 arranged on the hub 12. Each of the blades 13 and an inner wall of an impeller case 20 is arranged to extend obliquely along the slanting hub 12. That is, each blade 13, the inner wall of the impeller case 20, and the hub 12 are arranged to extend substantially parallel to one another and obliquely. This arrangement enables a gas sucked in through an air inlet 40 to efficiently flow into an air channel portion 50.

The hub 12 is may be arranged to extend obliquely downward and radially outward from an upper end portion of the outer circumferential surface of the boss portion 11. This arrangement contributes to more effectively preventing rotation of the impeller 10 from causing a shake of the shaft 31. Note that the upper end portion of the outer circumferential surface of the boss portion 11 refers to a portion of the outer circumferential surface of the boss portion 11 which is above a midpoint between an upper end and a lower end of the boss portion 11.

The present embodiment may also be directed to the centrifugal fan in which a radially inner end 13*a* of each blade 13 is arranged as radially inward as possible, and achieves an increase in the air volume and a reduction in noise by providing a curved surface projecting radially inward at a side end portion 20*a* of the air inlet 40 while decreasing the size of an opening of the air inlet 40.

Moreover, referring to FIG. 5, an annular shroud 14 may be arranged on an upper end portion of each blade 13. Here, a radially inner end 14*a* of the shroud 14 is arranged radially outward of a radially outer end 12*d* of the hub 12. This arrangement enables rotation of the blades 13 to cause the gas to efficiently flow into the air channel portion 50 from the air inlet 40 while reducing the likelihood that the gas will flow backward toward the air inlet 40. This leads to an increase in the static pressure, since a whirling flow of the gas is thereby easily generated and maintained in the air channel portion 50.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A centrifugal fan comprising:

an impeller arranged to rotate about a rotation axis;

an impeller case arranged to accommodate the impeller;

a motor arranged to rotate the impeller; and a motor case joined to the impeller case and arranged to accommodate the motor; wherein the impeller comprises:

a boss portion joined to a shaft arranged to rotate about the rotation axis;

a hub arranged to extend radially outward from an outer circumferential surface of the boss portion; and a plurality of blades arranged on an upper surface of the hub;

each blade is arranged to extend radially outward away from the rotation axis;

an inner wall of the impeller case is arranged to cover the blades, and comprises an inside surface extending radially outward along an upper end portion of each blade; and the impeller case comprises an air inlet defined in a central portion thereof, with a side end portion of the air inlet comprising a curved surface projecting radially inward;

wherein the curved surface of the air inlet is arranged to have an axial dimension smaller than a radial dimension thereof, the radial dimension being a dimension in a radial direction from a most radially inner point of the curved surface to a point where the curved surface extends furthest away from the impeller in an axial direction;

wherein the blades comprise:

a main blade arranged to extend radially outward from a point radially inward of a radially innermost end of the curved surface of the air inlet; and an auxiliary blade arranged to extend radially outward from a point radially outward of the radially innermost end of the curved surface of the air inlet;

the main blade has an axially upper end projecting upward and positioned radially outward of the radially innermost end of the curved surface of the air inlet;

a distance between the main blade and the inside surface of the impeller case is arranged to be shortest at the axially upper end of the main blade; and wherein a plurality of auxiliary blades is equidistantly located between the two adjacent main blades.

2. The centrifugal fan according to claim 1, wherein an upper end portion of the boss portion is arranged at a level lower than that of a radially innermost end of the curved surface of the air inlet.

3. The centrifugal fan according to claim 1, wherein an upper end portion of the boss portion is arranged radially inward of a radially innermost end of the curved surface of the air inlet.

4. The centrifugal fan according to claim 1, wherein the upper surface of the hub comprises a slanting surface arranged to extend from the outer circumferential surface of the boss portion obliquely downward and radially outward.

5. The centrifugal fan according to claim 4, wherein the slanting surface of the hub comprises a curved surface concaved radially inwardly and downwardly.

6. The centrifugal fan according to claim 4, wherein the upper surface of the hub further comprises a flat surface arranged to extend from a radially outer end of the slanting surface substantially perpendicularly to the rotation axis; and a periphery of the flat surface is arranged to project radially outwardly relative to a periphery of each blade.

7. The centrifugal fan according to claim 6, wherein the hub comprises a slanting surface radially outside the periphery of the flat surface, the slanting surface extending obliquely downward and radially outward.

8. The centrifugal fan according to claim 1, wherein the curved surface of the air inlet is arranged to project upwardly relative to a radially innermost end of the curved surface of the air inlet.

9. The centrifugal fan according to claim 1, wherein the auxiliary blade has a radially outer end at a radially outermost point of an upper end portion thereof; and a distance between the auxiliary blade and the inside surface of the impeller case is arranged to be shortest in an axial direction at the radially outer end of the auxiliary blade.

10. The centrifugal fan according to claim 1, further comprising an annular shroud arranged on the upper end portion of each blade, wherein a radially inner end of the shroud is arranged radially outward of a radially outer end of the hub.

11. A centrifugal fan comprising:

an impeller arranged to rotate about a rotation axis;

an impeller case arranged to accommodate the impeller;

wherein the impeller comprises:

a boss portion joined to a shaft arranged to rotate about the rotation axis;

a hub arranged to extend radially outward from an outer circumferential surface of the boss portion; and a plurality of blades arranged on an upper surface of the hub;

each blade is arranged to extend radially outward away from the rotation axis;

an inner wall of the impeller case is arranged to cover the blades, and comprises an inside surface extending radially outward along an upper end portion of each blade; and the impeller case comprises an air inlet defined in a central portion thereof, with a side end portion of the air inlet comprising a curved surface projecting radially inward;

wherein the curved surface of the air inlet is arranged to have an axial dimension smaller than a radial dimension thereof, the radial dimension being a dimension in a radial direction from a most radially inner point of the curved surface to a point where the curved surface extends furthest away from the impeller in an axial direction;

wherein the blades comprise:

a main blade arranged to extend radially outward from a point radially inward of a radially innermost end of the curved surface of the air inlet; and an auxiliary blade arranged to extend radially outward from a point radially outward of the radially innermost end of the curved surface of the air inlet;

the main blade has an axially upper end projecting upward and positioned radially outward of the radially innermost end of the curved surface of the air inlet; and a distance between the main blade and the inside surface of the impeller case is arranged to be shortest at the axially upper end of the main blade; and wherein a plurality of auxiliary blades is equidistantly located between the two adjacent main blades.

12. A centrifugal fan comprising:

an impeller arranged to rotate about a rotation axis;

an impeller case arranged to accommodate the impeller;

wherein the impeller comprises:

a boss portion joined to a shaft arranged to rotate about the rotation axis;

a hub arranged to extend radially outward from an outer circumferential surface of the boss portion; and a plurality of blades arranged on an upper surface of the hub;

each blade is arranged to extend radially outward away from the rotation axis;

an inner wall of the impeller case is arranged to cover the blades, and comprises an inside surface extending radially outward along an upper end portion of each blade; and the impeller case comprises an air inlet defined in a central portion thereof, with a side end portion of the air inlet comprising a curved surface projecting radially inward wherein the blades comprise:

a main blade arranged to extend radially outward from a point radially inward of a radially innermost end of the curved surface of the air inlet; and an auxiliary blade arranged to extend radially outward from a point radially outward of the radially innermost end of the curved surface of the air inlet;

the main blade has an axially upper end projecting upward and positioned radially outward of the radially innermost end of the curved surface of the air inlet;

a distance between the main blade and the inside surface of the impeller case is arranged to be shortest at the axially upper end of the main blade; and wherein a plurality of auxiliary blades is equidistantly located between the two adjacent main blades.

* * * * *